US011015459B2

(12) United States Patent
Vogel et al.

(10) Patent No.: US 11,015,459 B2
(45) Date of Patent: May 25, 2021

(54) ADDITIVE MANUFACTURING OPTIMIZED FIRST STAGE VANE

(71) Applicant: Power Systems Mfg., LLC, Jupiter, FL (US)

(72) Inventors: Gregory Edwin Vogel, Palm Beach Gardens, FL (US); Joshua Robert McNally, Jupiter, FL (US); Vladimir Kitaigorod, Wellington, FL (US)

(73) Assignee: Power Systems Mfg., LLC

( * ) Notice: Subject to any disclaimer, the term of this patent is extended or adjusted under 35 U.S.C. 154(b) by 75 days.

(21) Appl. No.: 16/598,550

(22) Filed: Oct. 10, 2019

(65) Prior Publication Data

US 2021/0108520 A1 Apr. 15, 2021

(51) Int. Cl.
*F01D 5/28* (2006.01)
*F01D 9/04* (2006.01)

(52) U.S. Cl.
CPC ..... *F01D 5/28* (2013.01); *F01D 9/04* (2013.01); *F05D 2220/32* (2013.01); *F05D 2300/17* (2013.01); *F05D 2300/611* (2013.01)

(58) Field of Classification Search
CPC ..... F01D 5/28; F01D 9/04; F05D 2220/32; F05D 2300/17; F05D 2300/611
See application file for complete search history.

(56) References Cited

U.S. PATENT DOCUMENTS

| | | | | |
|---|---|---|---|---|
| 6,398,489 | B1 | 6/2002 | Burdgick et al. | |
| 6,736,599 | B1 | 5/2004 | Jacks et al. | |
| 7,001,147 | B1 | 2/2006 | Phillips et al. | |
| 7,329,093 | B2 | 2/2008 | Vandeputte et al. | |
| 7,527,473 | B2 | 5/2009 | Humanchuk et al. | |
| 7,837,445 | B2 | 11/2010 | Benjamin et al. | |
| 8,573,945 | B2 * | 11/2013 | Wang | F01D 5/141 416/223 A |
| 10,774,652 | B2 * | 9/2020 | S | F01D 5/141 |
| 10,781,706 | B2 * | 9/2020 | Scholl | F01D 9/041 |
| 10,801,327 | B2 * | 10/2020 | Song | F04D 29/324 |
| 10,837,298 | B2 * | 11/2020 | Parker | F01D 9/041 |

* cited by examiner

*Primary Examiner* — Courtney D Heinle
*Assistant Examiner* — Sang K Kim
(74) *Attorney, Agent, or Firm* — Hovey Williams LLP

(57) ABSTRACT

An airfoil and turbine vanes and vane assemblies incorporating the same. The airfoil has an uncoated profile substantially in accordance with Cartesian coordinate values of X, Y, and Z as set forth in Table 1, carried to four decimal places. The Z values refer to a percentage of the radial span of the airfoil measured radially from a radially outwardly facing surface of the inner platform. The turbine vane includes an inner platform, an outer platform, and an airfoil such as the one discussed above extending radially outward from the inner platform toward the outer platform. And the vane assembly includes an inner platform, an outer platform, and two or more first stage vanes extending from the inner platform to the outer platform. Each of the two or more first stage vanes include an airfoil as discussed above.

20 Claims, 7 Drawing Sheets

ADDITIVE MANUFACTURING OPTIMIZED FIRST STAGE VANE

TECHNICAL FIELD

The present invention generally relates to gas turbine engines. More specifically, aspects of the invention are directed to a profile of a turbine vane such as that of a first stage turbine blade of a gas turbine engine.

BACKGROUND OF THE INVENTION

A typical gas turbine engine comprises a compressor, at least one combustor, and a turbine, with the compressor and turbine coupled together through an axial shaft. In operation, air passes through the compressor, where the pressure of the air increases and then passes to a combustion section, where fuel is mixed with the compressed air in one or more combustion chambers and ultimately ignited. The hot combustion gases then pass into the turbine and drive the turbine. As the turbine rotates, the compressor turns since they are coupled together along a common shaft. The turning of the shaft also drives a generator for electrical applications. The engine must operate within the confines of the environmental regulations for the area in which the engine is located. As a result, more advanced combustion systems have been developed to more efficiently mix fuel and air so as to provide more complete combustion, which results in lower emissions.

As the demand for more powerful and efficient turbine engines continues to increase, it is necessary to improve the efficiency at each stage of the turbine, so as to get the most work possible out of the turbine. To achieve this efficiency improvement, it is necessary to remove any design defects that limit the turbine from achieving its maximum performance. The stationary turbine vanes and rotating turbine blades have been known to be limited in power output by a variety of operating conditions. There thus remains a need an optimized profile of a turbine vane or blade to improve the vane's or blade's aerodynamic efficiency and performance.

BRIEF SUMMARY OF THE INVENTION

Embodiments of the present invention are directed towards an airfoil and turbine vanes and vane assemblies incorporating the same. The airfoil includes an improved profile substantially in accordance with the Cartesian coordinate values set forth in Table 1 herein.

More particularly, one embodiment of the invention is directed to an airfoil for a turbine vane. The airfoil has an uncoated profile substantially in accordance with Cartesian coordinate values of X, Y, and Z as set forth in Table 1, carried to four decimal places. The Z values refer to a percentage of the radial span of the airfoil measured radially from a radially outwardly facing surface of the inner platform.

Other embodiments of the invention are directed to a turbine vane. The turbine vane includes an inner platform, an outer platform, and an airfoil extending radially outward from the inner platform toward the outer platform. The airfoil has the uncoated profile substantially in accordance with Cartesian coordinate values of X, Y, and Z as set forth in Table 1.

Still other embodiments of the invention are directed to a vane assembly for a first stage of a turbine. The vane assembly includes an inner platform, an outer platform, and a plurality of first stage vanes extending from the inner platform to the outer platform. Each of the plurality of first stage blades include an airfoil having an uncoated profile substantially in accordance with Cartesian coordinate values of X, Y, and Z as set forth in Table 1.

Additional advantages and features of the present invention will be set forth in part in a description which follows, and in part will become apparent to those skilled in the art upon examination of the following or may be learned from practice of the invention.

BRIEF DESCRIPTION OF THE DRAWINGS

The present invention is described in detail below with reference to the attached drawing figures, wherein.

DETAILED DESCRIPTION OF THE INVENTION

The subject matter of the present invention is described with specificity herein to meet statutory requirements. However, the description itself is not intended to limit the scope of this patent. Rather, the inventors have contemplated that the claimed subject matter might also be embodied in other ways, to include different components, combinations of components, steps, or combinations of steps similar to the ones described in this document, in conjunction with other present or future technologies.

Figure 1:
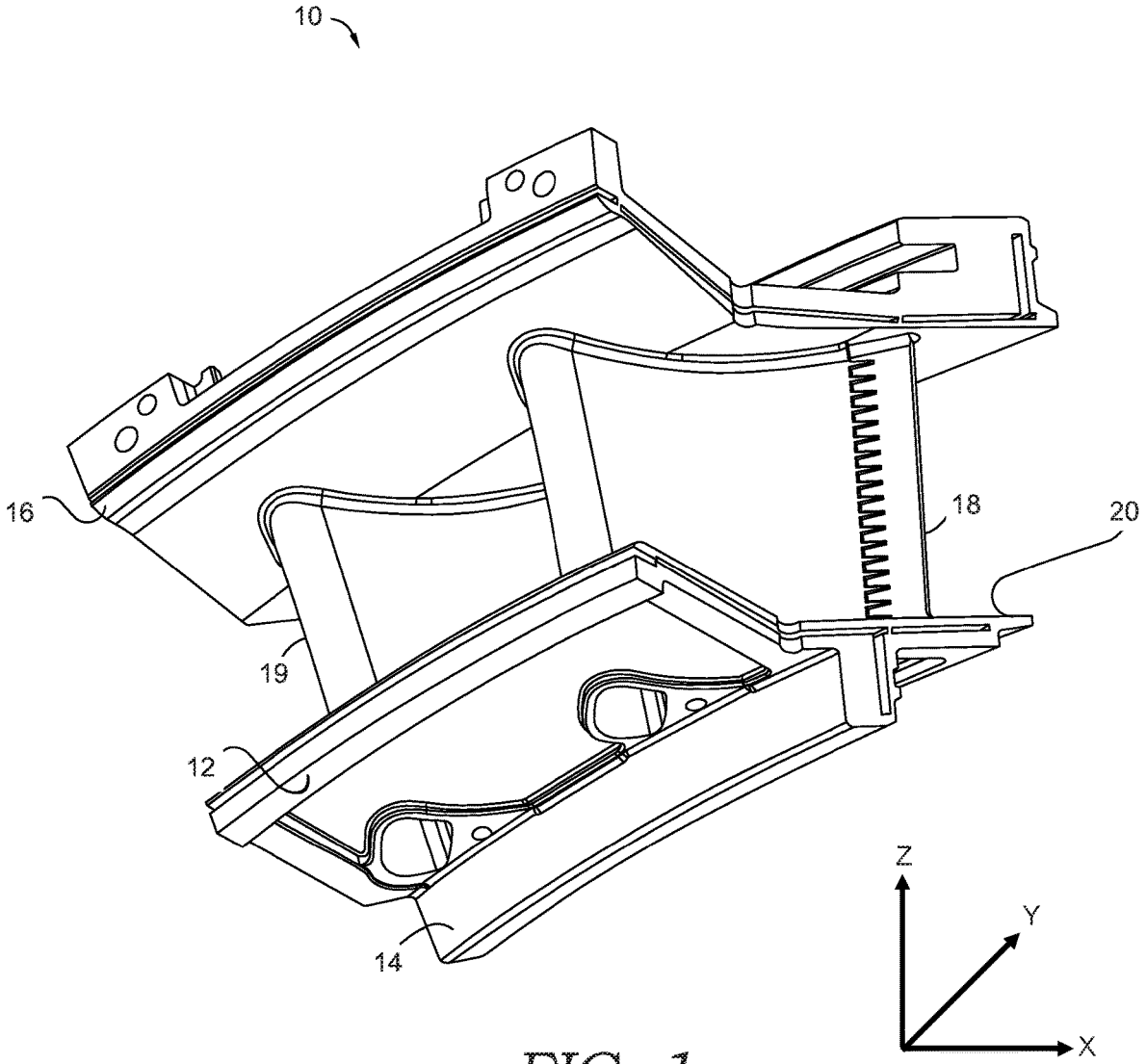
FIG. 1 is a perspective view of a turbine vane assembly including a plurality of turbine vanes according to one embodiment of the invention.

FIG. 1 shows a vane assembly 10 of a gas turbine engine that incorporates a plurality of vane airfoils 18, 19 having an outer profile according to embodiments of the present invention. The vane assembly 10 generally includes an inner platform 12, an inner rail 14, an outer platform 16, and the plurality of airfoil vanes 18, 19. The airfoil vanes 18, 19 extend between the inner platform 12 and the outer platform 16 and, more particularly, extend from a radially outwardly facing surface 20 of the inner platform 12 toward the outer platform 16. The inner rails 14 serves to seal the rim cavity region from leakage of cooling air into the hot gas path instead of passing into an interior of the vane airfoils 18, 19, while also stiffening the inner platform 12.

In some embodiments, a plurality of the vane assemblies 10 shown in FIG. 1 are operatively connected to form a radial array of vane airfoils comprising, for example, a turbine stage of a gas turbine engine. For example, in some embodiments the vane assembly 10 may form a portion of a first stage of turbine, and the vane airfoils 18, 19 are thus first stage turbine vanes. In such embodiments, the vane airfoils 18, 19 will form part of the first airfoils encountered by the hot combustion gasses leaving the combustor of the gas turbine engine. More particularly, during use hot combustion gasses leaving the combustor flow over the outer surface of the vane airfoils 18, 19, which increase the velocity of the hot combustion gasses. The combustion gasses are then directed over the first stage turbine blades, which spin and turn an axial shaft of the gas turbine engine, thus extracting energy from the hot gasses. The hot combustion gasses continue in the axial direction to the second, third, fourth, etc., stages of vanes and blades in the turbine.

Aspects of the invention are directed to the improved aerodynamic profile of the vane airfoils 18, 19 shown in FIG. 1. More particularly, each of the first stage vane airfoils 18, 19 has an uncoated profile defined by the Cartesian coordinates set forth in Table 1, carried out to four decimal places. The X and Y coordinates in Table 1 are provided in inches although other units of dimensions may be used without departing from the scope of the invention. Moreover, in some embodiments, due to manufacturing tolerances, the actual coordinates of the vane airfoils 18, 19 can vary in profile and position by about +/−0.100 inches. The Z values provided in Table 1 are nondimensional and represent a percentage of the total radial span of the vane airfoil—i.e., a percentage of the distance measured radially from the radially outwardly facing surface 20 of the inner platform 12 to a radially inwardly facing surface of the outer platform 14. In that regard, to convert the Z value set forth in Table 1 to a Z coordinate in inches or other dimensional unit, the nondimensional Z value in Table 1 is multiplied by the height of airfoil 18, 19 in inches (or another dimension, if so desired). Again, the height of the airfoil is measured between the two platforms 12, 16.

Orthogonally related X, Y, and Z axes corresponding to coordinates provided in Table 1 are shown in FIG. 1. The X, Y, and Z axes in FIG. 1 are shown relative to vane airfoil 18. It should be appreciated that, because the Z axis aligns with the radial direction at each vane, the corresponding axes for each subsequent vane in the radial array of vanes forming the turbine stage of will be rotated to some degree from those shown in FIG. 1.

The vane assembly 10 and/or turbine airfoils 18, 19 can be fabricated through any desired process such as, but not limited to, an additive manufacturing process or a casting and machining process. In one embodiment, the vane airfoils 18, 19 are cast from a nickel-based superalloy. Examples of acceptable alloys include, but are not limited to, Rene 80, GTD111, and MGA2400. In some embodiments, as a result of the casting process, the profile of the vane airfoils 18, 19 can vary typically up to +/−0.100 inches relative to the nominal coordinates shown in Table 1. In order to provide further thermal capability, in some embodiments the vane airfoils 18, 19 of the vane assembly 10 comprise a MCrAlY bond coating and thermal barrier ceramic coating of approximately 0.055 inches thick, where M can be a variety of metals including, but not limited to Cobalt, Nickel, or a Cobalt Nickel mixture. By application of the bond and thermal barrier coating, the vane assembly 10 achieves an improved oxidation resistance over the prior-art configuration.

The vane airfoils 18, 19 of the present invention are generated by connecting X, Y coordinates with a smooth arc at a number of Z positions extending radially outward from the inner platform 12. More particularly, a plurality of sections of X, Y coordinate data are first connected together using a smooth arc. These sections, some of which are shown in FIGS. 2-12 as will be discussed below, are then connected together by a series of smooth curves to generate the vane airfoil 18, 19 surfaces.

Figure 2:
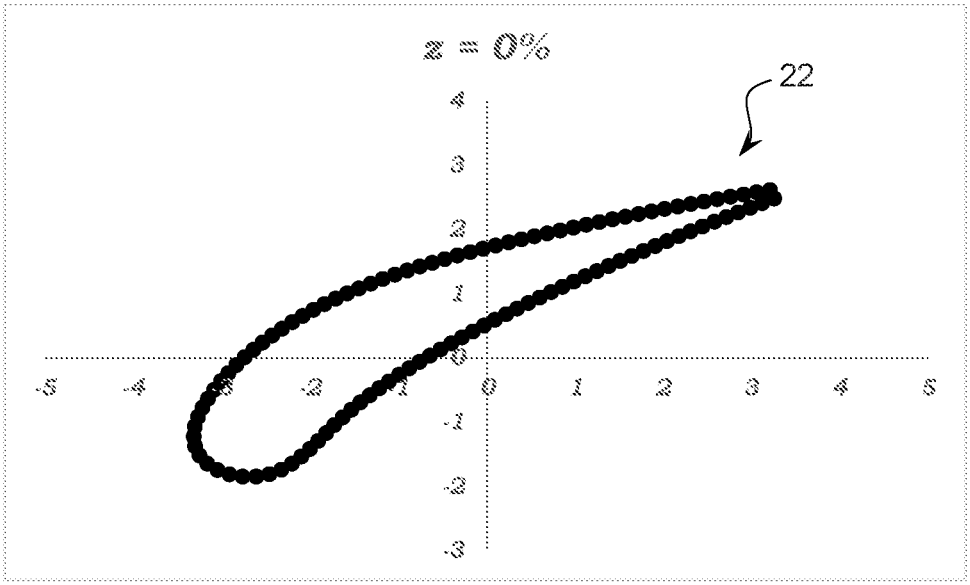
FIGS. 2-11 are scatter plots of X, Y coordinates from Table 1 at Z positions of 0%, 10%, 20%, 30%, 40%, 50%, 60%, 70%, 80%, and 90% of the vane airfoil's radial span, respectively, showing points along the outer aerodynamic surface of the vane airfoils shown in FIG. 1.
Figure 3:
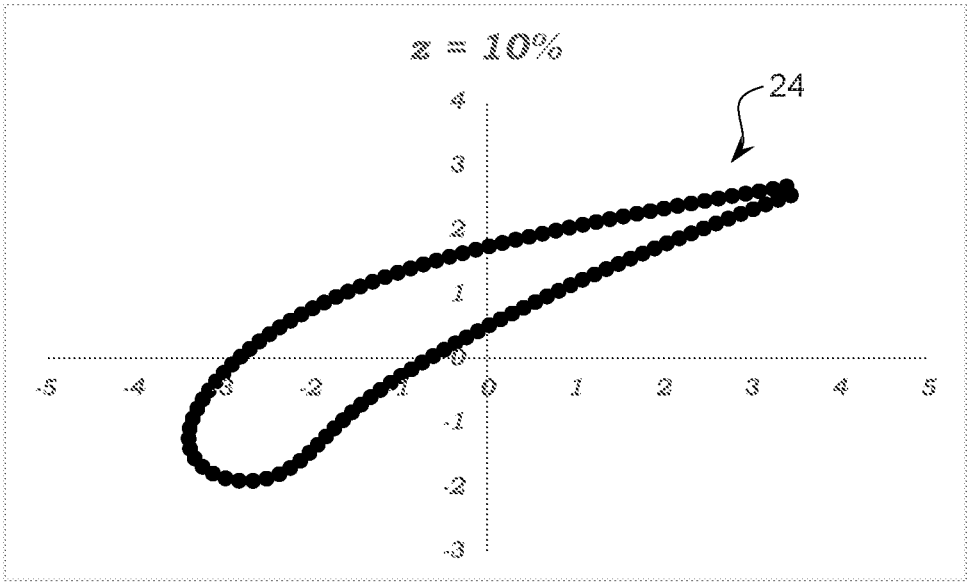
Figure 4:
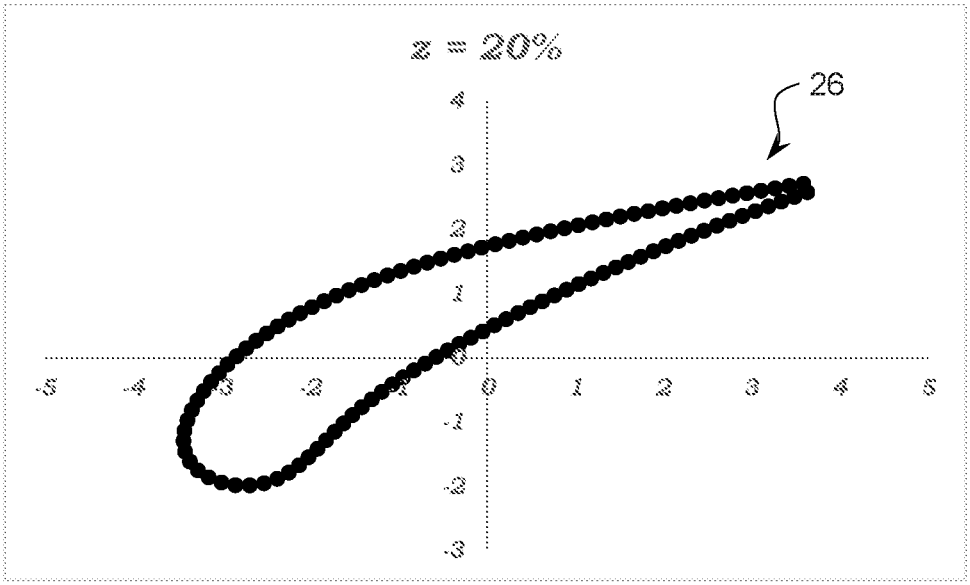
Figure 5:
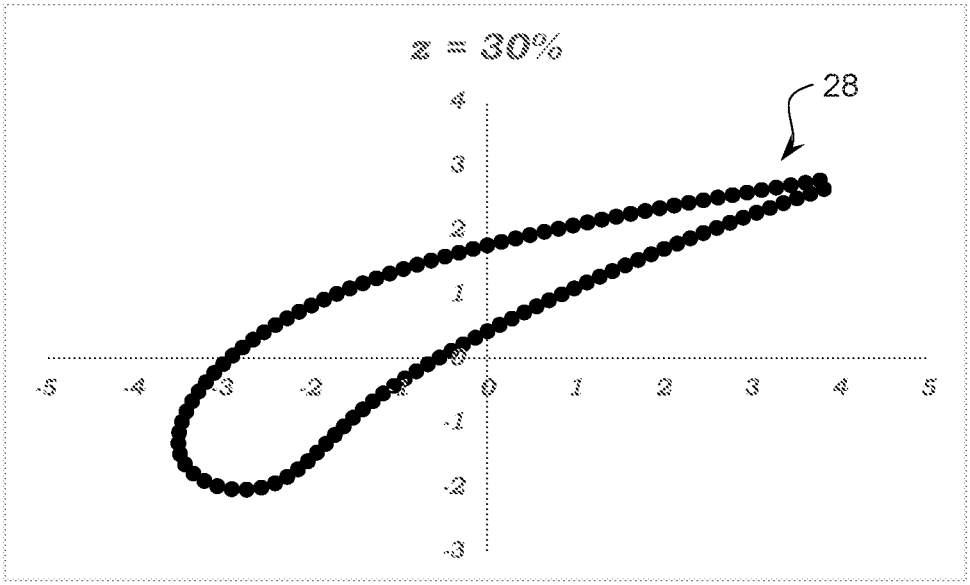
Figure 6:
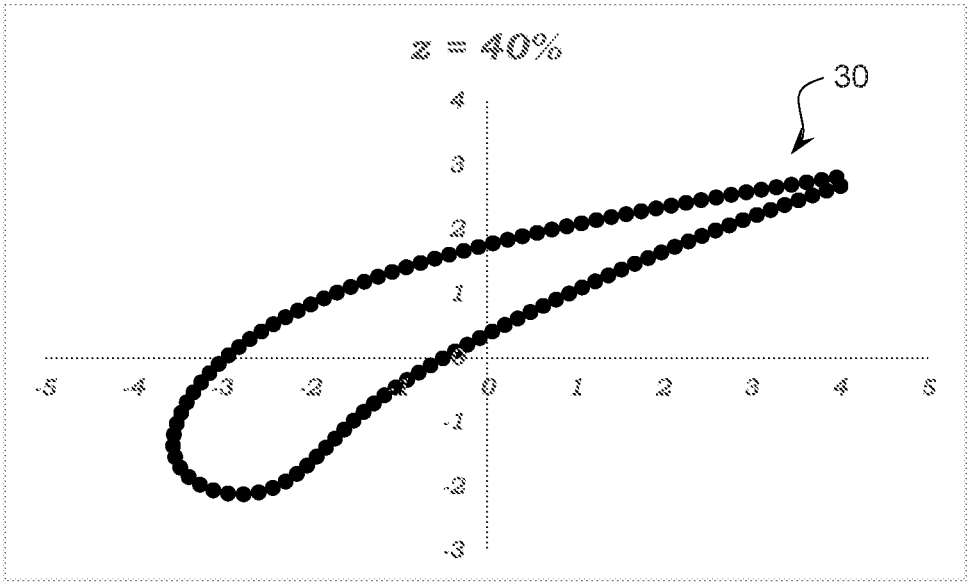
Figure 7:
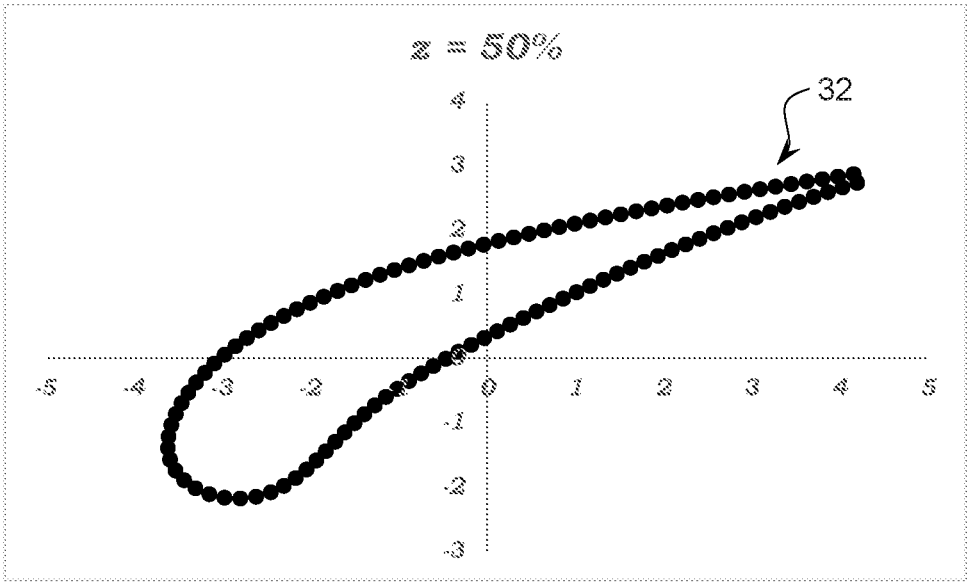
Figure 8:
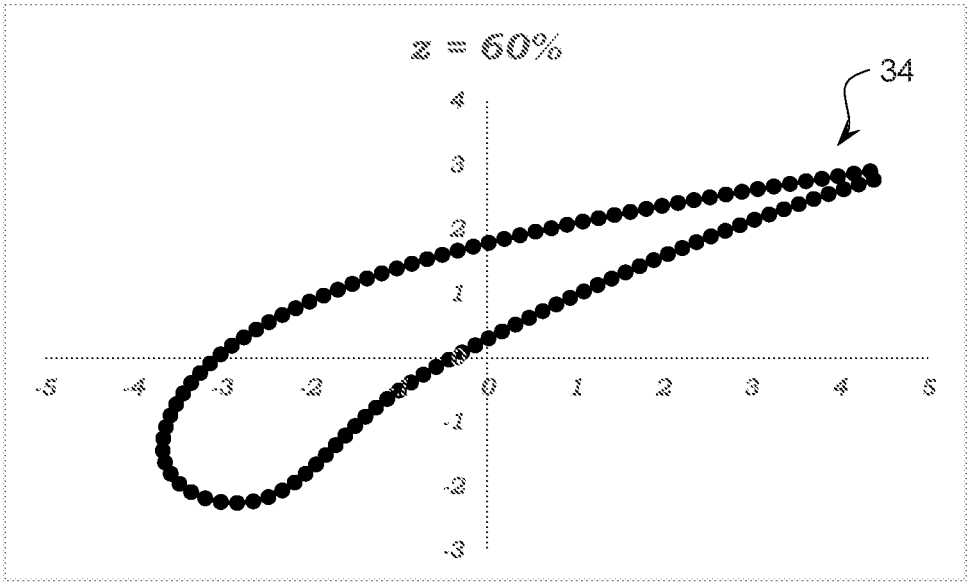
Figure 9:
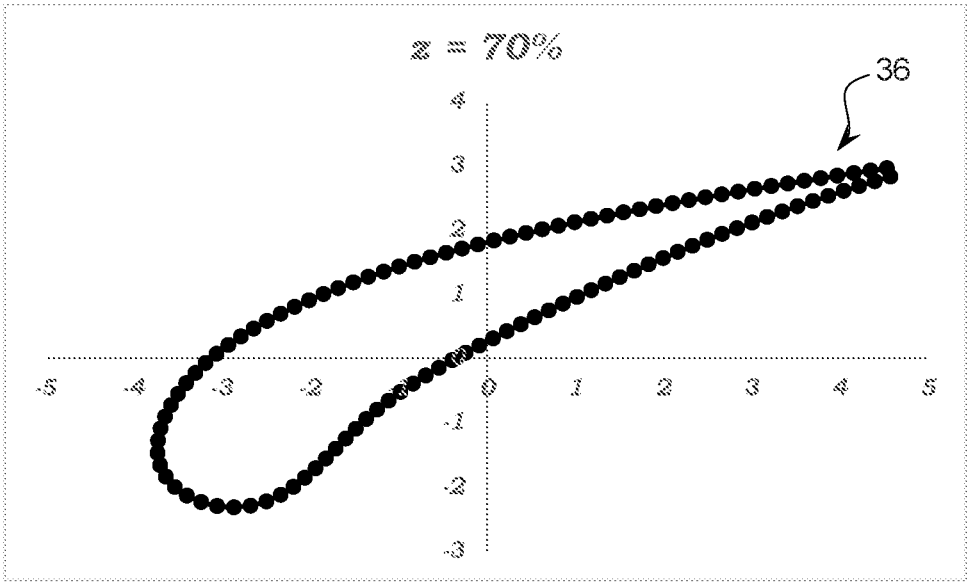
Figure 10:
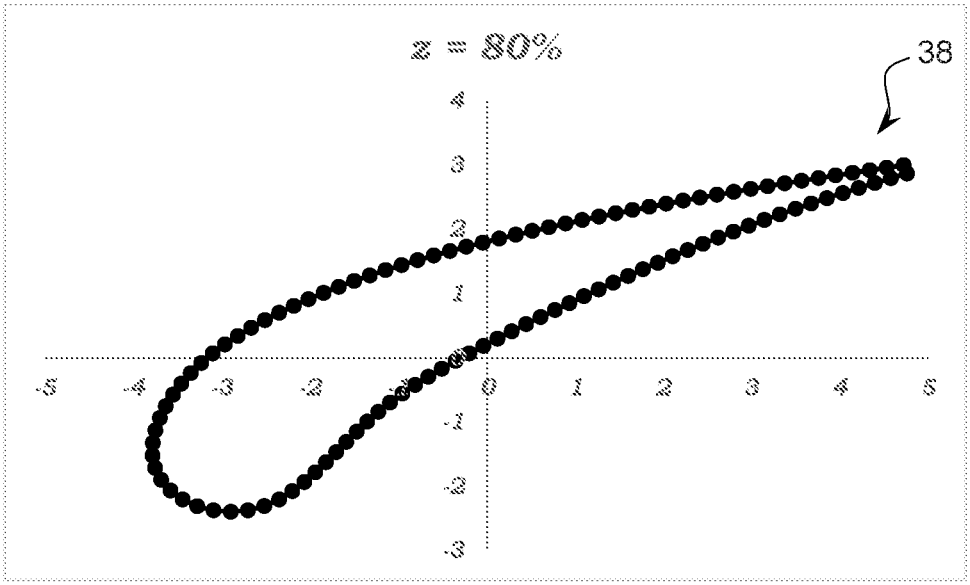
Figure 11:
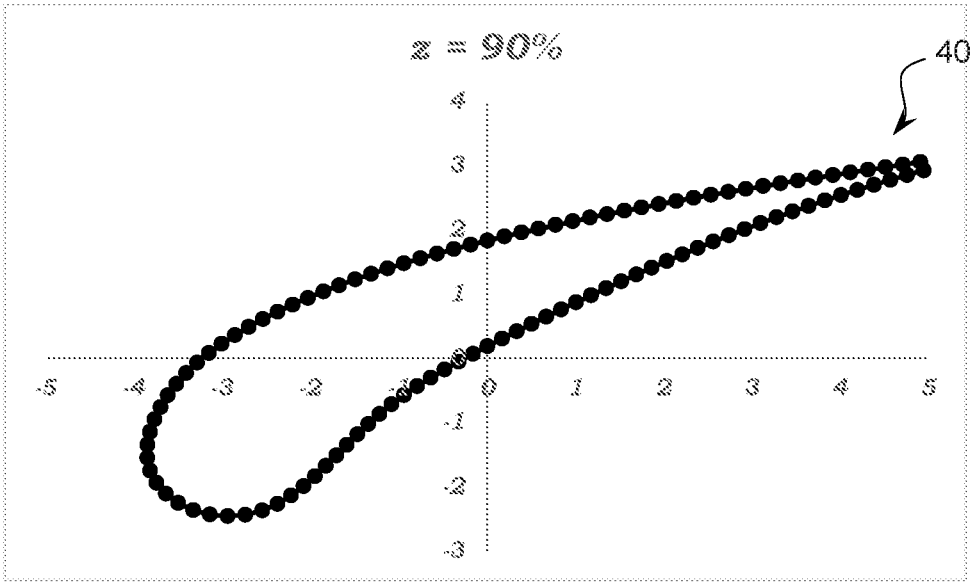

For example, FIGS. 2-11 show a plurality of cross-sectional profiles—profiles 22, 24, 26, 28, 30, 32, 34, 36, 38, and 40, respectively—of the vane airfoil 18 shown in FIG. 1 extending radially outward from the inner platform 12. Again, in some embodiments the vane airfoil 18 may be part of a first stage turbine vane in a gas turbine engine. Each profile is shown at a 10% increment in the total height of the vane airfoil 18 in the radial (i.e., the Z coordinate) direction. More particularly, profile 22 is shown at Z=0%, which is at the interface of vane airfoil 18 with the radially outwardly facing surface 20 of the inner platform 12. Profile 40 is shown at Z=90%; that is 90% of the radial span of the vane airfoil 18. And profiles 24, 26, 28, 30, 32, 34, 36, and 38 are shown at Z=10%, Z=20%, Z=30%, Z=40%, Z=50%, Z=60%, Z=70%, and Z=80%, respectively. As can be seen in FIG. 2, the X, Y, and Z Cartesian coordinates set forth in Table 1 are measured relative to an origin located proximate an apex of the vane airfoil 18's concave (i.e., pressure) side. The dimensions in the radial direction (i.e., Z direction) can be scaled according to application without departing from the scope of the invention. Furthermore the X, Y, and Z coordinates may be multiplied or divided by the same constant or number/factor to provide a scaled up or scaled down version of the vane airfoil 18 according to application without departing from the scope of the invention.

Figure 12:
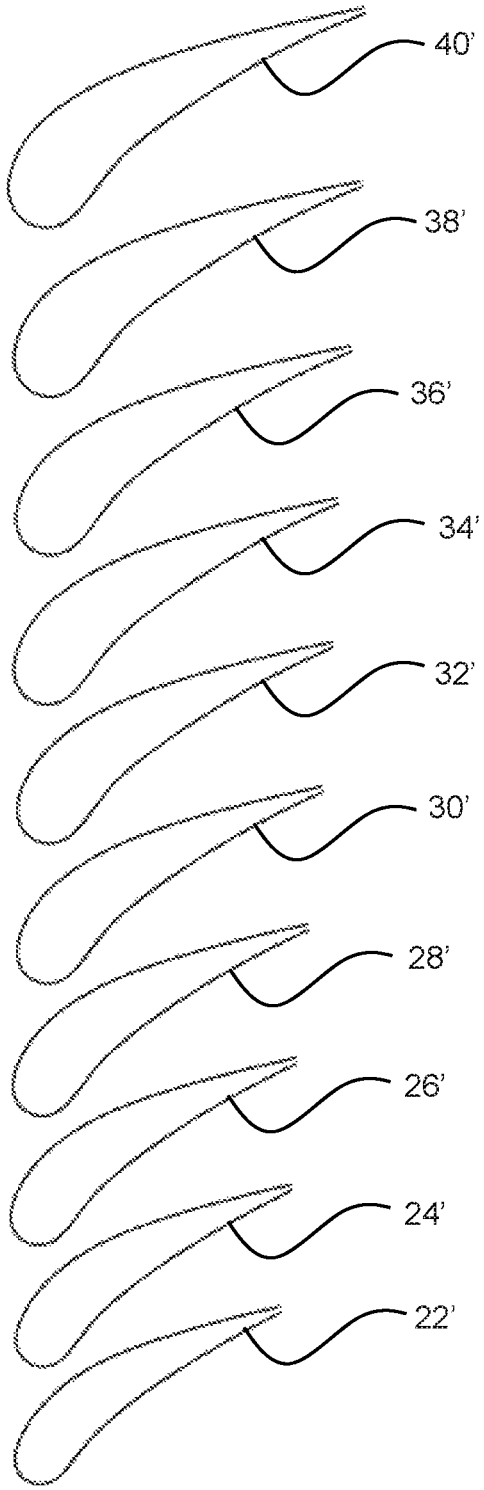
FIG. 12 shows a series of smooth arcs connecting the points in the scatter plots of X, Y coordinates shown in FIGS. 2-11.

The vane airfoil 18 of the present invention is generated by connecting the X, Y coordinates shown in each of the scatter plots with a smooth arc to form a plurality of profile sections, and by connecting those profile sections together by a series of smooth curves to generate the airfoil surface. More particularly, FIG. 12 shows profiles 22', 24', 26', 28', 30', 32', 34', 36', 38', and 40', which are formed by connecting the X, Y coordinates shown in each of the scatter plots 22, 24, 26, 28, 30, 32, 34, 36, 38, and 40, respectively, with a smooth arc to form the plurality of profile sections. These profiles 22', 24', 26', 28', 30', 32', 34', 36', 38', and 40' are in turn connected together by a series of smooth curves to generate the surface of vane airfoils 18, 19.

As best seen in FIG. 12, each profile 22', 24', 26', 28', 30', 32', 34', 36', 38', and 40' has an open trailing edge. This is because the particular trailing edge geometry of the vane airfoils 18, 19 may vary from application to application without departing from the scope of the invention. Put another way, the trailing edge points are undefined in Table 1 because any trailing edge exit airflow profile and pressure to suction side connection geometry can be integrated into the attached airfoil point geometry without departing from the scope of this invention.

The values given in Table 1 below represent the vane airfoil 18 profiles at ambient, non-operating (i.e., non-hot) conditions, for an uncoated airfoil 18. thus, it should be appreciated that the actual dimensions of a turbine vane according to aspects of the invention may vary from the coordinates shown in Table 1 when coated and/or when in use and thus subjected to hot combustion gasses. And again, due to manufacturing tolerances or the like, the actual coordinates of the vane airfoils 18, 19 can vary in profile and position by about +/−0.100 inches.

In another embodiment of the present invention, a plurality of vane airfoils 18, 19 are secured to an inner platform 12 to form the vane assembly 10. The plurality of vane airfoils 18, 19 each have an uncoated profile substantially in accordance with Cartesian coordinate values of X, Y, and Z as set forth in Table 1.

TABLE 1

| X | Y | Z |
|---|---|---|
| 3.2119 | 2.6161 | 0% |
| 3.0622 | 2.5811 | 0% |
| 2.9127 | 2.5457 | 0% |
| 2.7633 | 2.5096 | 0% |

TABLE 1-continued

| X | Y | Z |
|---|---|---|
| 2.6141 | 2.4729 | 0% |
| 2.4650 | 2.4357 | 0% |
| 2.3160 | 2.3979 | 0% |
| 2.1673 | 2.3594 | 0% |
| 2.0186 | 2.3204 | 0% |
| 1.8702 | 2.2808 | 0% |
| 1.7218 | 2.2406 | 0% |
| 1.5737 | 2.1998 | 0% |
| 1.4257 | 2.1584 | 0% |
| 1.2779 | 2.1163 | 0% |
| 1.1303 | 2.0736 | 0% |
| 0.9829 | 2.0302 | 0% |
| 0.8357 | 1.9860 | 0% |
| 0.6887 | 1.9410 | 0% |
| 0.5421 | 1.8951 | 0% |
| 0.3957 | 1.8483 | 0% |
| 0.2497 | 1.8003 | 0% |
| 0.1041 | 1.7512 | 0% |
| −0.0410 | 1.7008 | 0% |
| −0.1857 | 1.6489 | 0% |
| −0.3297 | 1.5954 | 0% |
| −0.4731 | 1.5401 | 0% |
| −0.6157 | 1.4828 | 0% |
| −0.7574 | 1.4233 | 0% |
| −0.8980 | 1.3612 | 0% |
| −1.0373 | 1.2965 | 0% |
| −1.1753 | 1.2288 | 0% |
| −1.3116 | 1.1579 | 0% |
| −1.4461 | 1.0836 | 0% |
| −1.5785 | 1.0056 | 0% |
| −1.7087 | 0.9239 | 0% |
| −1.8363 | 0.8383 | 0% |
| −1.9611 | 0.7487 | 0% |
| −2.0831 | 0.6552 | 0% |
| −2.2018 | 0.5577 | 0% |
| −2.3172 | 0.4562 | 0% |
| −2.4290 | 0.3508 | 0% |
| −2.5371 | 0.2416 | 0% |
| −2.6411 | 0.1284 | 0% |
| −2.7406 | 0.0114 | 0% |
| −2.8353 | −0.1097 | 0% |
| −2.9247 | −0.2346 | 0% |
| −3.0085 | −0.3634 | 0% |
| −3.0861 | −0.4960 | 0% |
| −3.1565 | −0.6326 | 0% |
| −3.2181 | −0.7734 | 0% |
| −3.2686 | −0.9184 | 0% |
| −3.3039 | −1.0679 | 0% |
| −3.3180 | −1.2208 | 0% |
| −3.3032 | −1.3734 | 0% |
| −3.2521 | −1.5179 | 0% |
| −3.1655 | −1.6443 | 0% |
| −3.0496 | −1.7446 | 0% |
| −2.9127 | −1.8136 | 0% |
| −2.7633 | −1.8482 | 0% |
| −2.6100 | −1.8468 | 0% |
| −2.4612 | −1.8099 | 0% |
| −2.3248 | −1.7399 | 0% |
| −2.2045 | −1.6445 | 0% |
| −2.0978 | −1.5340 | 0% |
| −2.0003 | −1.4153 | 0% |
| −1.9079 | −1.2925 | 0% |
| −1.8173 | −1.1684 | 0% |
| −1.7255 | −1.0452 | 0% |
| −1.6304 | −0.9245 | 0% |
| −1.5315 | −0.8068 | 0% |
| −1.4293 | −0.6921 | 0% |
| −1.3238 | −0.5803 | 0% |
| −1.2155 | −0.4714 | 0% |
| −1.1045 | −0.3651 | 0% |
| −0.9910 | −0.2614 | 0% |
| −0.8756 | −0.1600 | 0% |
| −0.7585 | −0.0605 | 0% |
| −0.6399 | 0.0372 | 0% |
| −0.5200 | 0.1333 | 0% |
| −0.3989 | 0.2279 | 0% |
| −0.2768 | 0.3212 | 0% |
| −0.1538 | 0.4133 | 0% |

TABLE 1-continued

| X | Y | Z |
|---|---|---|
| −0.0299 | 0.5042 | 0% |
| 0.0949 | 0.5939 | 0% |
| 0.2205 | 0.6825 | 0% |
| 0.3469 | 0.7699 | 0% |
| 0.4740 | 0.8562 | 0% |
| 0.6019 | 0.9414 | 0% |
| 0.7305 | 1.0255 | 0% |
| 0.8597 | 1.1086 | 0% |
| 0.9896 | 1.1908 | 0% |
| 1.1201 | 1.2720 | 0% |
| 1.2510 | 1.3524 | 0% |
| 1.3824 | 1.4321 | 0% |
| 1.5143 | 1.5110 | 0% |
| 1.6465 | 1.5893 | 0% |
| 1.7791 | 1.6670 | 0% |
| 1.9120 | 1.7441 | 0% |
| 2.0453 | 1.8207 | 0% |
| 2.1788 | 1.8966 | 0% |
| 2.3128 | 1.9720 | 0% |
| 2.4470 | 2.0467 | 0% |
| 2.5816 | 2.1209 | 0% |
| 2.7165 | 2.1945 | 0% |
| 2.8518 | 2.2675 | 0% |
| 2.9873 | 2.3398 | 0% |
| 3.1232 | 2.4116 | 0% |
| 3.2594 | 2.4829 | 0% |
| 3.4013 | 2.6646 | 10% |
| 3.2463 | 2.6291 | 10% |
| 3.0914 | 2.5931 | 10% |
| 2.9366 | 2.5566 | 10% |
| 2.7819 | 2.5194 | 10% |
| 2.6274 | 2.4817 | 10% |
| 2.4730 | 2.4434 | 10% |
| 2.3188 | 2.4045 | 10% |
| 2.1647 | 2.3651 | 10% |
| 2.0108 | 2.3250 | 10% |
| 1.8570 | 2.2843 | 10% |
| 1.7034 | 2.2430 | 10% |
| 1.5500 | 2.2010 | 10% |
| 1.3967 | 2.1584 | 10% |
| 1.2437 | 2.1151 | 10% |
| 1.0908 | 2.0711 | 10% |
| 0.9382 | 2.0262 | 10% |
| 0.7859 | 1.9804 | 10% |
| 0.6339 | 1.9337 | 10% |
| 0.4821 | 1.8860 | 10% |
| 0.3307 | 1.8373 | 10% |
| 0.1797 | 1.7873 | 10% |
| 0.0292 | 1.7360 | 10% |
| −0.1209 | 1.6832 | 10% |
| −0.2704 | 1.6289 | 10% |
| −0.4192 | 1.5727 | 10% |
| −0.5672 | 1.5145 | 10% |
| −0.7143 | 1.4541 | 10% |
| −0.8604 | 1.3912 | 10% |
| −1.0053 | 1.3255 | 10% |
| −1.1488 | 1.2569 | 10% |
| −1.2907 | 1.1850 | 10% |
| −1.4308 | 1.1097 | 10% |
| −1.5689 | 1.0308 | 10% |
| −1.7047 | 0.9481 | 10% |
| −1.8381 | 0.8614 | 10% |
| −1.9688 | 0.7708 | 10% |
| −2.0966 | 0.6761 | 10% |
| −2.2212 | 0.5773 | 10% |
| −2.3423 | 0.4742 | 10% |
| −2.4597 | 0.3669 | 10% |
| −2.5731 | 0.2554 | 10% |
| −2.6821 | 0.1395 | 10% |
| −2.7862 | 0.0193 | 10% |
| −2.8849 | −0.1054 | 10% |
| −2.9779 | −0.2344 | 10% |
| −3.0645 | −0.3678 | 10% |
| −3.1442 | −0.5055 | 10% |
| −3.2159 | −0.6474 | 10% |
| −3.2782 | −0.7937 | 10% |
| −3.3287 | −0.9445 | 10% |
| −3.3633 | −1.0997 | 10% |

TABLE 1-continued

| X | Y | Z |
|---|---|---|
| −3.3760 | −1.2580 | 10% |
| −3.3593 | −1.4159 | 10% |
| −3.3063 | −1.5654 | 10% |
| −3.2175 | −1.6969 | 10% |
| −3.0990 | −1.8023 | 10% |
| −2.9584 | −1.8760 | 10% |
| −2.8045 | −1.9145 | 10% |
| −2.6458 | −1.9161 | 10% |
| −2.4911 | −1.8809 | 10% |
| −2.3484 | −1.8113 | 10% |
| −2.2222 | −1.7148 | 10% |
| −2.1101 | −1.6021 | 10% |
| −2.0079 | −1.4802 | 10% |
| −1.9116 | −1.3536 | 10% |
| −1.8177 | −1.2253 | 10% |
| −1.7232 | −1.0973 | 10% |
| −1.6258 | −0.9715 | 10% |
| −1.5249 | −0.8486 | 10% |
| −1.4203 | −0.7288 | 10% |
| −1.3121 | −0.6122 | 10% |
| −1.2005 | −0.4989 | 10% |
| −1.0858 | −0.3887 | 10% |
| −0.9683 | −0.2815 | 10% |
| −0.8486 | −0.1767 | 10% |
| −0.7270 | −0.0742 | 10% |
| −0.6038 | 0.0264 | 10% |
| −0.4792 | 0.1252 | 10% |
| −0.3534 | 0.2225 | 10% |
| −0.2265 | 0.3185 | 10% |
| −0.0987 | 0.4131 | 10% |
| 0.0300 | 0.5066 | 10% |
| 0.1595 | 0.5990 | 10% |
| 0.2898 | 0.6902 | 10% |
| 0.4209 | 0.7802 | 10% |
| 0.5528 | 0.8692 | 10% |
| 0.6854 | 0.9570 | 10% |
| 0.8187 | 1.0438 | 10% |
| 0.9526 | 1.1295 | 10% |
| 1.0872 | 1.2143 | 10% |
| 1.2225 | 1.2980 | 10% |
| 1.3582 | 1.3809 | 10% |
| 1.4945 | 1.4629 | 10% |
| 1.6313 | 1.5441 | 10% |
| 1.7685 | 1.6245 | 10% |
| 1.9062 | 1.7041 | 10% |
| 2.0443 | 1.7830 | 10% |
| 2.1828 | 1.8612 | 10% |
| 2.3218 | 1.9387 | 10% |
| 2.4611 | 2.0154 | 10% |
| 2.6009 | 2.0913 | 10% |
| 2.7410 | 2.1665 | 10% |
| 2.8816 | 2.2410 | 10% |
| 3.0225 | 2.3147 | 10% |
| 3.1638 | 2.3877 | 10% |
| 3.3055 | 2.4600 | 10% |
| 3.4476 | 2.5315 | 10% |
| 3.5907 | 2.7131 | 20% |
| 3.4303 | 2.6771 | 20% |
| 3.2699 | 2.6405 | 20% |
| 3.1097 | 2.6035 | 20% |
| 2.9496 | 2.5658 | 20% |
| 2.7897 | 2.5277 | 20% |
| 2.6299 | 2.4889 | 20% |
| 2.4702 | 2.4496 | 20% |
| 2.3107 | 2.4096 | 20% |
| 2.1513 | 2.3691 | 20% |
| 1.9921 | 2.3279 | 20% |
| 1.8330 | 2.2861 | 20% |
| 1.6741 | 2.2436 | 20% |
| 1.5155 | 2.2004 | 20% |
| 1.3570 | 2.1565 | 20% |
| 1.1987 | 2.1118 | 20% |
| 1.0407 | 2.0662 | 20% |
| 0.8830 | 2.0198 | 20% |
| 0.7255 | 1.9723 | 20% |
| 0.5684 | 1.9238 | 20% |
| 0.4116 | 1.8741 | 20% |
| 0.2552 | 1.8233 | 20% |

TABLE 1-continued

| X | Y | Z |
|---|---|---|
| 0.0993 | 1.7711 | 20% |
| −0.0562 | 1.7174 | 20% |
| −0.2111 | 1.6622 | 20% |
| −0.3653 | 1.6051 | 20% |
| −0.5188 | 1.5460 | 20% |
| −0.6714 | 1.4847 | 20% |
| −0.8230 | 1.4209 | 20% |
| −0.9733 | 1.3543 | 20% |
| −1.1223 | 1.2847 | 20% |
| −1.2698 | 1.2119 | 20% |
| −1.4154 | 1.1356 | 20% |
| −1.5591 | 1.0556 | 20% |
| −1.7007 | 0.9719 | 20% |
| −1.8398 | 0.8842 | 20% |
| −1.9763 | 0.7924 | 20% |
| −2.1098 | 0.6966 | 20% |
| −2.2402 | 0.5964 | 20% |
| −2.3671 | 0.4918 | 20% |
| −2.4901 | 0.3826 | 20% |
| −2.6089 | 0.2689 | 20% |
| −2.7229 | 0.1504 | 20% |
| −2.8317 | 0.0271 | 20% |
| −2.9346 | −0.1012 | 20% |
| −3.0311 | −0.2343 | 20% |
| −3.1206 | −0.3723 | 20% |
| −3.2023 | −0.5149 | 20% |
| −3.2755 | −0.6622 | 20% |
| −3.3385 | −0.8141 | 20% |
| −3.3890 | −0.9705 | 20% |
| −3.4229 | −1.1313 | 20% |
| −3.4342 | −1.2952 | 20% |
| −3.4156 | −1.4583 | 20% |
| −3.3606 | −1.6129 | 20% |
| −3.2697 | −1.7494 | 20% |
| −3.1484 | −1.8599 | 20% |
| −3.0042 | −1.9382 | 20% |
| −2.8457 | −1.9806 | 20% |
| −2.6817 | −1.9851 | 20% |
| −2.5211 | −1.9517 | 20% |
| −2.3722 | −1.8825 | 20% |
| −2.2400 | −1.7850 | 20% |
| −2.1226 | −1.6700 | 20% |
| −2.0158 | −1.5450 | 20% |
| −1.9154 | −1.4147 | 20% |
| −1.8181 | −1.2822 | 20% |
| −1.7207 | −1.1496 | 20% |
| −1.6211 | −1.0188 | 20% |
| −1.5181 | −0.8906 | 20% |
| −1.4112 | −0.7657 | 20% |
| −1.3002 | −0.6443 | 20% |
| −1.1855 | −0.5265 | 20% |
| −1.0671 | −0.4123 | 20% |
| −0.9457 | −0.3015 | 20% |
| −0.8217 | −0.1934 | 20% |
| −0.6956 | −0.0878 | 20% |
| −0.5678 | 0.0157 | 20% |
| −0.4385 | 0.1173 | 20% |
| −0.3079 | 0.2172 | 20% |
| −0.1763 | 0.3158 | 20% |
| −0.0437 | 0.4131 | 20% |
| 0.0897 | 0.5092 | 20% |
| 0.2240 | 0.6041 | 20% |
| 0.3591 | 0.6980 | 20% |
| 0.4949 | 0.7906 | 20% |
| 0.6315 | 0.8822 | 20% |
| 0.7688 | 0.9727 | 20% |
| 0.9068 | 1.0621 | 20% |
| 1.0455 | 1.1505 | 20% |
| 1.1849 | 1.2378 | 20% |
| 1.3249 | 1.3241 | 20% |
| 1.4655 | 1.4095 | 20% |
| 1.6066 | 1.4938 | 20% |
| 1.7483 | 1.5773 | 20% |
| 1.8906 | 1.6598 | 20% |
| 2.0334 | 1.7414 | 20% |
| 2.1766 | 1.8221 | 20% |
| 2.3204 | 1.9020 | 20% |
| 2.4647 | 1.9809 | 20% |

TABLE 1-continued

| X | Y | Z |
|---|---|---|
| 2.6095 | 2.0589 | 20% |
| 2.7547 | 2.1360 | 20% |
| 2.9004 | 2.2122 | 20% |
| 3.0466 | 2.2875 | 20% |
| 3.1933 | 2.3620 | 20% |
| 3.3403 | 2.4356 | 20% |
| 3.4878 | 2.5083 | 20% |
| 3.6357 | 2.5802 | 20% |
| 3.7801 | 2.7616 | 30% |
| 3.6142 | 2.7250 | 30% |
| 3.4485 | 2.6879 | 30% |
| 3.2828 | 2.6503 | 30% |
| 3.1173 | 2.6122 | 30% |
| 2.9519 | 2.5736 | 30% |
| 2.7867 | 2.5343 | 30% |
| 2.6215 | 2.4945 | 30% |
| 2.4565 | 2.4541 | 30% |
| 2.2917 | 2.4131 | 30% |
| 2.1270 | 2.3715 | 30% |
| 1.9626 | 2.3291 | 30% |
| 1.7982 | 2.2861 | 30% |
| 1.6341 | 2.2424 | 30% |
| 1.4702 | 2.1979 | 30% |
| 1.3065 | 2.1525 | 30% |
| 1.1431 | 2.1062 | 30% |
| 0.9799 | 2.0590 | 30% |
| 0.8171 | 2.0107 | 30% |
| 0.6545 | 1.9614 | 30% |
| 0.4924 | 1.9109 | 30% |
| 0.3306 | 1.8591 | 30% |
| 0.1692 | 1.8061 | 30% |
| 0.0084 | 1.7515 | 30% |
| −0.1519 | 1.6953 | 30% |
| −0.3116 | 1.6373 | 30% |
| −0.4705 | 1.5773 | 30% |
| −0.6285 | 1.5151 | 30% |
| −0.7855 | 1.4504 | 30% |
| −0.9414 | 1.3829 | 30% |
| −1.0959 | 1.3123 | 30% |
| −1.2489 | 1.2385 | 30% |
| −1.4001 | 1.1612 | 30% |
| −1.5494 | 1.0802 | 30% |
| −1.6965 | 0.9953 | 30% |
| −1.8413 | 0.9065 | 30% |
| −1.9835 | 0.8137 | 30% |
| −2.1229 | 0.7166 | 30% |
| −2.2590 | 0.6150 | 30% |
| −2.3917 | 0.5089 | 30% |
| −2.5203 | 0.3980 | 30% |
| −2.6444 | 0.2821 | 30% |
| −2.7636 | 0.1610 | 30% |
| −2.8771 | 0.0347 | 30% |
| −2.9842 | −0.0971 | 30% |
| −3.0844 | −0.2342 | 30% |
| −3.1768 | −0.3767 | 30% |
| −3.2607 | −0.5244 | 30% |
| −3.3352 | −0.6770 | 30% |
| −3.3988 | −0.8344 | 30% |
| −3.4494 | −0.9965 | 30% |
| −3.4826 | −1.1630 | 30% |
| −3.4925 | −1.3324 | 30% |
| −3.4720 | −1.5007 | 30% |
| −3.4150 | −1.6603 | 30% |
| −3.3218 | −1.8019 | 30% |
| −3.1978 | −1.9173 | 30% |
| −3.0500 | −2.0002 | 30% |
| −2.8870 | −2.0465 | 30% |
| −2.7177 | −2.0539 | 30% |
| −2.5512 | −2.0223 | 30% |
| −2.3962 | −1.9535 | 30% |
| −2.2581 | −1.8551 | 30% |
| −2.1354 | −1.7378 | 30% |
| −2.0238 | −1.6097 | 30% |
| −1.9194 | −1.4758 | 30% |
| −1.8185 | −1.3392 | 30% |
| −1.7182 | −1.2021 | 30% |
| −1.6161 | −1.0663 | 30% |
| −1.5110 | −0.9329 | 30% |

TABLE 1-continued

| X | Y | Z |
|---|---|---|
| −1.4018 | −0.8028 | 30% |
| −1.2883 | −0.6765 | 30% |
| −1.1704 | −0.5542 | 30% |
| −1.0485 | −0.4360 | 30% |
| −0.9230 | −0.3214 | 30% |
| −0.7948 | −0.2100 | 30% |
| −0.6643 | −0.1013 | 30% |
| −0.5319 | 0.0050 | 30% |
| −0.3979 | 0.1094 | 30% |
| −0.2625 | 0.2120 | 30% |
| −0.1261 | 0.3132 | 30% |
| 0.0113 | 0.4131 | 30% |
| 0.1495 | 0.5118 | 30% |
| 0.2885 | 0.6094 | 30% |
| 0.4284 | 0.7058 | 30% |
| 0.5689 | 0.8012 | 30% |
| 0.7103 | 0.8954 | 30% |
| 0.8523 | 0.9885 | 30% |
| 0.9950 | 1.0806 | 30% |
| 1.1385 | 1.1716 | 30% |
| 1.2826 | 1.2615 | 30% |
| 1.4273 | 1.3504 | 30% |
| 1.5727 | 1.4382 | 30% |
| 1.7188 | 1.5249 | 30% |
| 1.8654 | 1.6106 | 30% |
| 2.0127 | 1.6952 | 30% |
| 2.1605 | 1.7788 | 30% |
| 2.3090 | 1.8614 | 30% |
| 2.4580 | 1.9429 | 30% |
| 2.6076 | 2.0233 | 30% |
| 2.7578 | 2.1026 | 30% |
| 2.9086 | 2.1809 | 30% |
| 3.0599 | 2.2581 | 30% |
| 3.2117 | 2.3343 | 30% |
| 3.3640 | 2.4094 | 30% |
| 3.5168 | 2.4836 | 30% |
| 3.6701 | 2.5567 | 30% |
| 3.8239 | 2.6288 | 30% |
| 3.9694 | 2.8100 | 40% |
| 3.7981 | 2.7729 | 40% |
| 3.6269 | 2.7353 | 40% |
| 3.4559 | 2.6972 | 40% |
| 3.2849 | 2.6586 | 40% |
| 3.1141 | 2.6194 | 40% |
| 2.9434 | 2.5797 | 40% |
| 2.7728 | 2.5395 | 40% |
| 2.6024 | 2.4986 | 40% |
| 2.4321 | 2.4571 | 40% |
| 2.2620 | 2.4150 | 40% |
| 2.0920 | 2.3721 | 40% |
| 1.9222 | 2.3286 | 40% |
| 1.7527 | 2.2843 | 40% |
| 1.5833 | 2.2391 | 40% |
| 1.4142 | 2.1931 | 40% |
| 1.2454 | 2.1461 | 40% |
| 1.0768 | 2.0981 | 40% |
| 0.9085 | 2.0491 | 40% |
| 0.7406 | 1.9989 | 40% |
| 0.5730 | 1.9475 | 40% |
| 0.4059 | 1.8949 | 40% |
| 0.2391 | 1.8409 | 40% |
| 0.0729 | 1.7854 | 40% |
| −0.0928 | 1.7283 | 40% |
| −0.2579 | 1.6694 | 40% |
| −0.4222 | 1.6085 | 40% |
| −0.5857 | 1.5454 | 40% |
| −0.7482 | 1.4797 | 40% |
| −0.9095 | 1.4113 | 40% |
| −1.0695 | 1.3397 | 40% |
| −1.2280 | 1.2649 | 40% |
| −1.3848 | 1.1865 | 40% |
| −1.5396 | 1.1044 | 40% |
| −1.6924 | 1.0185 | 40% |
| −1.8428 | 0.9286 | 40% |
| −1.9907 | 0.8345 | 40% |
| −2.1357 | 0.7362 | 40% |
| −2.2776 | 0.6333 | 40% |
| −2.4159 | 0.5257 | 40% |

TABLE 1-continued

| X | Y | Z |
|---|---|---|
| −2.5501 | 0.4130 | 40% |
| −2.6797 | 0.2950 | 40% |
| −2.8040 | 0.1715 | 40% |
| −2.9223 | 0.0422 | 40% |
| −3.0338 | −0.0930 | 40% |
| −3.1377 | −0.2342 | 40% |
| −3.2331 | −0.3812 | 40% |
| −3.3191 | −0.5339 | 40% |
| −3.3950 | −0.6918 | 40% |
| −3.4594 | −0.8548 | 40% |
| −3.5100 | −1.0225 | 40% |
| −3.5424 | −1.1946 | 40% |
| −3.5509 | −1.3695 | 40% |
| −3.5285 | −1.5430 | 40% |
| −3.4694 | −1.7076 | 40% |
| −3.3740 | −1.8542 | 40% |
| −3.2472 | −1.9746 | 40% |
| −3.0958 | −2.0621 | 40% |
| −2.9283 | −2.1122 | 40% |
| −2.7537 | −2.1226 | 40% |
| −2.5814 | −2.0927 | 40% |
| −2.4204 | −2.0244 | 40% |
| −2.2764 | −1.9249 | 40% |
| −2.1483 | −1.8054 | 40% |
| −2.0320 | −1.6744 | 40% |
| −1.9234 | −1.5368 | 40% |
| −1.8189 | −1.3961 | 40% |
| −1.7156 | −1.2546 | 40% |
| −1.6110 | −1.1139 | 40% |
| −1.5036 | −0.9754 | 40% |
| −1.3923 | −0.8401 | 40% |
| −1.2762 | −0.7088 | 40% |
| −1.1553 | −0.5819 | 40% |
| −1.0298 | −0.4596 | 40% |
| −0.9004 | −0.3413 | 40% |
| −0.7680 | −0.2266 | 40% |
| −0.6330 | −0.1148 | 40% |
| −0.4960 | −0.0055 | 40% |
| −0.3573 | 0.1016 | 40% |
| −0.2172 | 0.2069 | 40% |
| −0.0759 | 0.3107 | 40% |
| 0.0662 | 0.4132 | 40% |
| 0.2092 | 0.5146 | 40% |
| 0.3530 | 0.6147 | 40% |
| 0.4976 | 0.7138 | 40% |
| 0.6429 | 0.8118 | 40% |
| 0.7890 | 0.9086 | 40% |
| 0.9358 | 1.0044 | 40% |
| 1.0833 | 1.0991 | 40% |
| 1.2314 | 1.1927 | 40% |
| 1.3803 | 1.2852 | 40% |
| 1.5298 | 1.3767 | 40% |
| 1.6800 | 1.4670 | 40% |
| 1.8309 | 1.5561 | 40% |
| 1.9825 | 1.6440 | 40% |
| 2.1348 | 1.7308 | 40% |
| 2.2877 | 1.8164 | 40% |
| 2.4414 | 1.9008 | 40% |
| 2.5957 | 1.9839 | 40% |
| 2.7506 | 2.0658 | 40% |
| 2.9062 | 2.1464 | 40% |
| 3.0625 | 2.2258 | 40% |
| 3.2193 | 2.3040 | 40% |
| 3.3767 | 2.3811 | 40% |
| 3.5347 | 2.4569 | 40% |
| 3.6933 | 2.5316 | 40% |
| 3.8524 | 2.6051 | 40% |
| 4.0120 | 2.6775 | 40% |
| 4.1587 | 2.8584 | 50% |
| 3.9820 | 2.8207 | 50% |
| 3.8054 | 2.7826 | 50% |
| 3.6289 | 2.7440 | 50% |
| 3.4525 | 2.7049 | 50% |
| 3.2762 | 2.6652 | 50% |
| 3.1000 | 2.6251 | 50% |
| 2.9240 | 2.5843 | 50% |
| 2.7481 | 2.5430 | 50% |
| 2.5724 | 2.5010 | 50% |

TABLE 1-continued

| X | Y | Z |
|---|---|---|
| 2.3968 | 2.4584 | 50% |
| 2.2214 | 2.4151 | 50% |
| 2.0462 | 2.3710 | 50% |
| 1.8712 | 2.3261 | 50% |
| 1.6964 | 2.2803 | 50% |
| 1.5218 | 2.2336 | 50% |
| 1.3476 | 2.1860 | 50% |
| 1.1736 | 2.1372 | 50% |
| 0.9999 | 2.0874 | 50% |
| 0.8266 | 2.0364 | 50% |
| 0.6536 | 1.9841 | 50% |
| 0.4811 | 1.9306 | 50% |
| 0.3089 | 1.8757 | 50% |
| 0.1373 | 1.8193 | 50% |
| −0.0338 | 1.7613 | 50% |
| −0.2043 | 1.7014 | 50% |
| −0.3740 | 1.6396 | 50% |
| −0.5430 | 1.5755 | 50% |
| −0.7109 | 1.5089 | 50% |
| −0.8777 | 1.4395 | 50% |
| −1.0432 | 1.3670 | 50% |
| −1.2072 | 1.2911 | 50% |
| −1.3695 | 1.2116 | 50% |
| −1.5298 | 1.1284 | 50% |
| −1.6881 | 1.0413 | 50% |
| −1.8442 | 0.9503 | 50% |
| −1.9977 | 0.8550 | 50% |
| −2.1484 | 0.7554 | 50% |
| −2.2960 | 0.6512 | 50% |
| −2.4400 | 0.5421 | 50% |
| −2.5798 | 0.4277 | 50% |
| −2.7149 | 0.3076 | 50% |
| −2.8444 | 0.1817 | 50% |
| −2.9675 | 0.0495 | 50% |
| −3.0834 | −0.0891 | 50% |
| −3.1911 | −0.2342 | 50% |
| −3.2894 | −0.3857 | 50% |
| −3.3776 | −0.5433 | 50% |
| −3.4549 | −0.7066 | 50% |
| −3.5200 | −0.8751 | 50% |
| −3.5706 | −1.0485 | 50% |
| −3.6024 | −1.2262 | 50% |
| −3.6095 | −1.4066 | 50% |
| −3.5851 | −1.5853 | 50% |
| −3.5240 | −1.7549 | 50% |
| −3.4263 | −1.9064 | 50% |
| −3.2967 | −2.0318 | 50% |
| −3.1417 | −2.1238 | 50% |
| −2.9697 | −2.1777 | 50% |
| −2.7899 | −2.1910 | 50% |
| −2.6118 | −2.1629 | 50% |
| −2.4448 | −2.0950 | 50% |
| −2.2948 | −1.9947 | 50% |
| −2.1614 | −1.8730 | 50% |
| −2.0403 | −1.7390 | 50% |
| −1.9276 | −1.5978 | 50% |
| −1.8194 | −1.4531 | 50% |
| −1.7129 | −1.3071 | 50% |
| −1.6057 | −1.1617 | 50% |
| −1.4961 | −1.0181 | 50% |
| −1.3825 | −0.8775 | 50% |
| −1.2640 | −0.7412 | 50% |
| −1.1401 | −0.6097 | 50% |
| −1.0111 | −0.4832 | 50% |
| −0.8779 | −0.3612 | 50% |
| −0.7411 | −0.2431 | 50% |
| −0.6017 | −0.1282 | 50% |
| −0.4601 | −0.0160 | 50% |
| −0.3167 | 0.0939 | 50% |
| −0.1718 | 0.2019 | 50% |
| −0.0258 | 0.3083 | 50% |
| 0.1211 | 0.4134 | 50% |
| 0.2689 | 0.5174 | 50% |
| 0.4175 | 0.6202 | 50% |
| 0.5669 | 0.7218 | 50% |
| 0.7170 | 0.8224 | 50% |
| 0.8678 | 0.9219 | 50% |
| 1.0193 | 1.0203 | 50% |

TABLE 1-continued

| X | Y | Z |
|---|---|---|
| 1.1715 | 1.1177 | 50% |
| 1.3244 | 1.2139 | 50% |
| 1.4780 | 1.3091 | 50% |
| 1.6323 | 1.4031 | 50% |
| 1.7873 | 1.4958 | 50% |
| 1.9431 | 1.5874 | 50% |
| 2.0996 | 1.6776 | 50% |
| 2.2569 | 1.7665 | 50% |
| 2.4150 | 1.8541 | 50% |
| 2.5737 | 1.9403 | 50% |
| 2.7333 | 2.0251 | 50% |
| 2.8936 | 2.1084 | 50% |
| 3.0546 | 2.1904 | 50% |
| 3.2163 | 2.2709 | 50% |
| 3.3787 | 2.3501 | 50% |
| 3.5418 | 2.4280 | 50% |
| 3.7055 | 2.5045 | 50% |
| 3.8698 | 2.5797 | 50% |
| 4.0346 | 2.6536 | 50% |
| 4.2001 | 2.7261 | 50% |
| 4.3479 | 2.9068 | 60% |
| 4.1657 | 2.8685 | 60% |
| 3.9837 | 2.8298 | 60% |
| 3.8018 | 2.7907 | 60% |
| 3.6199 | 2.7511 | 60% |
| 3.4382 | 2.7110 | 60% |
| 3.2566 | 2.6704 | 60% |
| 3.0751 | 2.6292 | 60% |
| 2.8938 | 2.5874 | 60% |
| 2.7126 | 2.5449 | 60% |
| 2.5316 | 2.5018 | 60% |
| 2.3507 | 2.4579 | 60% |
| 2.1701 | 2.4133 | 60% |
| 1.9896 | 2.3678 | 60% |
| 1.8094 | 2.3215 | 60% |
| 1.6294 | 2.2741 | 60% |
| 1.4497 | 2.2258 | 60% |
| 1.2703 | 2.1763 | 60% |
| 1.0912 | 2.1256 | 60% |
| 0.9125 | 2.0738 | 60% |
| 0.7341 | 2.0207 | 60% |
| 0.5562 | 1.9662 | 60% |
| 0.3787 | 1.9104 | 60% |
| 0.2016 | 1.8531 | 60% |
| 0.0251 | 1.7941 | 60% |
| −0.1508 | 1.7333 | 60% |
| −0.3259 | 1.6705 | 60% |
| −0.5003 | 1.6054 | 60% |
| −0.6737 | 1.5379 | 60% |
| −0.8460 | 1.4675 | 60% |
| −1.0169 | 1.3940 | 60% |
| −1.1864 | 1.3171 | 60% |
| −1.3541 | 1.2365 | 60% |
| −1.5200 | 1.1522 | 60% |
| −1.6839 | 1.0640 | 60% |
| −1.8455 | 0.9717 | 60% |
| −2.0046 | 0.8753 | 60% |
| −2.1610 | 0.7744 | 60% |
| −2.3142 | 0.6688 | 60% |
| −2.4639 | 0.5581 | 60% |
| −2.6093 | 0.4420 | 60% |
| −2.7498 | 0.3200 | 60% |
| −2.8846 | 0.1917 | 60% |
| −3.0126 | 0.0567 | 60% |
| −3.1329 | −0.0852 | 60% |
| −3.2444 | −0.2342 | 60% |
| −3.3458 | −0.3902 | 60% |
| −3.4363 | −0.5528 | 60% |
| −3.5150 | −0.7214 | 60% |
| −3.5808 | −0.8954 | 60% |
| −3.6313 | −1.0744 | 60% |
| −3.6624 | −1.2578 | 60% |
| −3.6681 | −1.4436 | 60% |
| −3.6419 | −1.6276 | 60% |
| −3.5786 | −1.8022 | 60% |
| −3.4785 | −1.9586 | 60% |
| −3.3461 | −2.0888 | 60% |
| −3.1875 | −2.1854 | 60% |

TABLE 1-continued

| X | Y | Z |
|---|---|---|
| −3.0110 | −2.2432 | 60% |
| −2.8261 | −2.2594 | 60% |
| −2.6423 | −2.2330 | 60% |
| −2.4692 | −2.1656 | 60% |
| −2.3134 | −2.0643 | 60% |
| −2.1746 | −1.9405 | 60% |
| −2.0488 | −1.8034 | 60% |
| −1.9318 | −1.6587 | 60% |
| −1.8199 | −1.5100 | 60% |
| −1.7102 | −1.3597 | 60% |
| −1.6003 | −1.2096 | 60% |
| −1.4883 | −1.0609 | 60% |
| −1.3726 | −0.9152 | 60% |
| −1.2516 | −0.7738 | 60% |
| −1.1248 | −0.6376 | 60% |
| −0.9925 | −0.5068 | 60% |
| −0.8553 | −0.3810 | 60% |
| −0.7144 | −0.2595 | 60% |
| −0.5705 | −0.1415 | 60% |
| −0.4243 | −0.0264 | 60% |
| −0.2762 | 0.0863 | 60% |
| −0.1266 | 0.1970 | 60% |
| 0.0243 | 0.3060 | 60% |
| 0.1760 | 0.4137 | 60% |
| 0.3286 | 0.5202 | 60% |
| 0.4820 | 0.6256 | 60% |
| 0.6361 | 0.7299 | 60% |
| 0.7910 | 0.8331 | 60% |
| 0.9465 | 0.9353 | 60% |
| 1.1028 | 1.0363 | 60% |
| 1.2598 | 1.1363 | 60% |
| 1.4174 | 1.2352 | 60% |
| 1.5757 | 1.3330 | 60% |
| 1.7348 | 1.4295 | 60% |
| 1.8947 | 1.5248 | 60% |
| 2.0553 | 1.6188 | 60% |
| 2.2168 | 1.7113 | 60% |
| 2.3791 | 1.8024 | 60% |
| 2.5422 | 1.8919 | 60% |
| 2.7061 | 1.9800 | 60% |
| 2.8710 | 2.0664 | 60% |
| 3.0366 | 2.1512 | 60% |
| 3.2030 | 2.2345 | 60% |
| 3.3702 | 2.3162 | 60% |
| 3.5382 | 2.3963 | 60% |
| 3.7069 | 2.4750 | 60% |
| 3.8762 | 2.5521 | 60% |
| 4.0462 | 2.6278 | 60% |
| 4.2169 | 2.7020 | 60% |
| 4.3882 | 2.7747 | 60% |
| 4.5370 | 2.9551 | 70% |
| 4.3495 | 2.9163 | 70% |
| 4.1620 | 2.8771 | 70% |
| 3.9746 | 2.8375 | 70% |
| 3.7874 | 2.7974 | 70% |
| 3.6002 | 2.7568 | 70% |
| 3.4131 | 2.7157 | 70% |
| 3.2262 | 2.6740 | 70% |
| 3.0394 | 2.6317 | 70% |
| 2.8528 | 2.5888 | 70% |
| 2.6663 | 2.5452 | 70% |
| 2.4800 | 2.5008 | 70% |
| 2.2939 | 2.4556 | 70% |
| 2.1080 | 2.4095 | 70% |
| 1.9223 | 2.3626 | 70% |
| 1.7369 | 2.3146 | 70% |
| 1.5518 | 2.2655 | 70% |
| 1.3669 | 2.2153 | 70% |
| 1.1824 | 2.1638 | 70% |
| 0.9983 | 2.1111 | 70% |
| 0.8146 | 2.0571 | 70% |
| 0.6312 | 2.0018 | 70% |
| 0.4483 | 1.9450 | 70% |
| 0.2659 | 1.8867 | 70% |
| 0.0840 | 1.8268 | 70% |
| −0.0973 | 1.7650 | 70% |
| −0.2779 | 1.7013 | 70% |
| −0.4577 | 1.6353 | 70% |

TABLE 1-continued

| X | Y | Z |
|---|---|---|
| −0.6366 | 1.5668 | 70% |
| −0.8143 | 1.4954 | 70% |
| −0.9907 | 1.4209 | 70% |
| −1.1656 | 1.3429 | 70% |
| −1.3389 | 1.2613 | 70% |
| −1.5103 | 1.1758 | 70% |
| −1.6796 | 1.0864 | 70% |
| −1.8468 | 0.9929 | 70% |
| −2.0115 | 0.8952 | 70% |
| −2.1735 | 0.7930 | 70% |
| −2.3323 | 0.6861 | 70% |
| −2.4876 | 0.5739 | 70% |
| −2.6386 | 0.4561 | 70% |
| −2.7846 | 0.3322 | 70% |
| −2.9246 | 0.2016 | 70% |
| −3.0576 | 0.0638 | 70% |
| −3.1824 | −0.0815 | 70% |
| −3.2978 | −0.2343 | 70% |
| −3.4023 | −0.3947 | 70% |
| −3.4950 | −0.5623 | 70% |
| −3.5751 | −0.7362 | 70% |
| −3.6416 | −0.9157 | 70% |
| −3.6922 | −1.1004 | 70% |
| −3.7226 | −1.2893 | 70% |
| −3.7269 | −1.4806 | 70% |
| −3.6988 | −1.6698 | 70% |
| −3.6333 | −1.8494 | 70% |
| −3.5308 | −2.0107 | 70% |
| −3.3956 | −2.1458 | 70% |
| −3.2334 | −2.2468 | 70% |
| −3.0525 | −2.3084 | 70% |
| −2.8623 | −2.3275 | 70% |
| −2.6728 | −2.3030 | 70% |
| −2.4938 | −2.2360 | 70% |
| −2.3322 | −2.1337 | 70% |
| −2.1880 | −2.0079 | 70% |
| −2.0574 | −1.8679 | 70% |
| −1.9361 | −1.7196 | 70% |
| −1.8205 | −1.5670 | 70% |
| −1.7075 | −1.4124 | 70% |
| −1.5947 | −1.2575 | 70% |
| −1.4804 | −1.1039 | 70% |
| −1.3625 | −0.9530 | 70% |
| −1.2392 | −0.8065 | 70% |
| −1.1095 | −0.6655 | 70% |
| −0.9738 | −0.5305 | 70% |
| −0.8328 | −0.4009 | 70% |
| −0.6876 | −0.2759 | 70% |
| −0.5393 | −0.1548 | 70% |
| −0.3885 | −0.0367 | 70% |
| −0.2357 | 0.0788 | 70% |
| −0.0813 | 0.1921 | 70% |
| 0.0743 | 0.3037 | 70% |
| 0.2309 | 0.4140 | 70% |
| 0.3883 | 0.5232 | 70% |
| 0.5464 | 0.6312 | 70% |
| 0.7053 | 0.7381 | 70% |
| 0.8649 | 0.8439 | 70% |
| 1.0253 | 0.9487 | 70% |
| 1.1863 | 1.0524 | 70% |
| 1.3480 | 1.1550 | 70% |
| 1.5104 | 1.2565 | 70% |
| 1.6735 | 1.3569 | 70% |
| 1.8374 | 1.4560 | 70% |
| 2.0020 | 1.5538 | 70% |
| 2.1676 | 1.6502 | 70% |
| 2.3339 | 1.7451 | 70% |
| 2.5012 | 1.8383 | 70% |
| 2.6694 | 1.9299 | 70% |
| 2.8386 | 2.0197 | 70% |
| 3.0086 | 2.1078 | 70% |
| 3.1796 | 2.1941 | 70% |
| 3.3515 | 2.2787 | 70% |
| 3.5242 | 2.3615 | 70% |
| 3.6977 | 2.4426 | 70% |
| 3.8719 | 2.5220 | 70% |
| 4.0469 | 2.5998 | 70% |
| 4.2227 | 2.6760 | 70% |

TABLE 1-continued

| X | Y | Z |
|---|---|---|
| 4.3991 | 2.7505 | 70% |
| 4.5762 | 2.8233 | 70% |
| 4.7261 | 3.0034 | 80% |
| 4.5332 | 2.9641 | 80% |
| 4.3403 | 2.9243 | 80% |
| 4.1475 | 2.8842 | 80% |
| 3.9547 | 2.8436 | 80% |
| 3.7621 | 2.8025 | 80% |
| 3.5696 | 2.7609 | 80% |
| 3.3772 | 2.7188 | 80% |
| 3.1850 | 2.6760 | 80% |
| 2.9929 | 2.6326 | 80% |
| 2.8009 | 2.5885 | 80% |
| 2.6092 | 2.5436 | 80% |
| 2.4176 | 2.4978 | 80% |
| 2.2262 | 2.4512 | 80% |
| 2.0351 | 2.4036 | 80% |
| 1.8443 | 2.3549 | 80% |
| 1.6537 | 2.3052 | 80% |
| 1.4635 | 2.2542 | 80% |
| 1.2736 | 2.2020 | 80% |
| 1.0841 | 2.1484 | 80% |
| 0.8949 | 2.0935 | 80% |
| 0.7062 | 2.0373 | 80% |
| 0.5179 | 1.9796 | 80% |
| 0.3300 | 1.9203 | 80% |
| 0.1427 | 1.8594 | 80% |
| −0.0439 | 1.7967 | 80% |
| −0.2300 | 1.7320 | 80% |
| −0.4152 | 1.6650 | 80% |
| −0.5995 | 1.5955 | 80% |
| −0.7826 | 1.5232 | 80% |
| −0.9645 | 1.4477 | 80% |
| −1.1449 | 1.3686 | 80% |
| −1.3236 | 1.2859 | 80% |
| −1.5005 | 1.1992 | 80% |
| −1.6754 | 1.1086 | 80% |
| −1.8480 | 1.0139 | 80% |
| −2.0183 | 0.9149 | 80% |
| −2.1858 | 0.8114 | 80% |
| −2.3503 | 0.7031 | 80% |
| −2.5111 | 0.5894 | 80% |
| −2.6677 | 0.4700 | 80% |
| −2.8192 | 0.3441 | 80% |
| −2.9645 | 0.2112 | 80% |
| −3.1025 | 0.0707 | 80% |
| −3.2318 | −0.0778 | 80% |
| −3.3511 | −0.2344 | 80% |
| −3.4588 | −0.3993 | 80% |
| −3.5538 | −0.5718 | 80% |
| −3.6353 | −0.7510 | 80% |
| −3.7025 | −0.9360 | 80% |
| −3.7531 | −1.1263 | 80% |
| −3.7828 | −1.3209 | 80% |
| −3.7858 | −1.5176 | 80% |
| −3.7557 | −1.7120 | 80% |
| −3.6880 | −1.8966 | 80% |
| −3.5831 | −2.0628 | 80% |
| −3.4450 | −2.2027 | 80% |
| −3.2792 | −2.3082 | 80% |
| −3.0939 | −2.3736 | 80% |
| −2.8986 | −2.3955 | 80% |
| −2.7034 | −2.3728 | 80% |
| −2.5184 | −2.3063 | 80% |
| −2.3510 | −2.2031 | 80% |
| −2.2015 | −2.0752 | 80% |
| −2.0660 | −1.9323 | 80% |
| −1.9405 | −1.7805 | 80% |
| −1.8211 | −1.6239 | 80% |
| −1.7047 | −1.4650 | 80% |
| −1.5891 | −1.3056 | 80% |
| −1.4723 | −1.1470 | 80% |
| −1.3522 | −0.9909 | 80% |
| −1.2266 | −0.8393 | 80% |
| −1.0941 | −0.6935 | 80% |
| −0.9550 | −0.5541 | 80% |
| −0.8102 | −0.4207 | 80% |
| −0.6609 | −0.2923 | 80% |

TABLE 1-continued

| X | Y | Z |
|---|---|---|
| −0.5081 | −0.1680 | 80% |
| −0.3527 | −0.0470 | 80% |
| −0.1952 | 0.0713 | 80% |
| −0.0361 | 0.1873 | 80% |
| 0.1243 | 0.3016 | 80% |
| 0.2857 | 0.4145 | 80% |
| 0.4479 | 0.5262 | 80% |
| 0.6109 | 0.6368 | 80% |
| 0.7745 | 0.7463 | 80% |
| 0.9389 | 0.8548 | 80% |
| 1.1040 | 0.9622 | 80% |
| 1.2698 | 1.0685 | 80% |
| 1.4363 | 1.1737 | 80% |
| 1.6034 | 1.2779 | 80% |
| 1.7713 | 1.3809 | 80% |
| 1.9399 | 1.4826 | 80% |
| 2.1094 | 1.5830 | 80% |
| 2.2798 | 1.6817 | 80% |
| 2.4511 | 1.7789 | 80% |
| 2.6234 | 1.8743 | 80% |
| 2.7967 | 1.9679 | 80% |
| 2.9710 | 2.0596 | 80% |
| 3.1463 | 2.1494 | 80% |
| 3.3226 | 2.2371 | 80% |
| 3.4999 | 2.3229 | 80% |
| 3.6781 | 2.4069 | 80% |
| 3.8571 | 2.4889 | 80% |
| 4.0370 | 2.5691 | 80% |
| 4.2176 | 2.6476 | 80% |
| 4.3991 | 2.7242 | 80% |
| 4.5813 | 2.7990 | 80% |
| 4.7642 | 2.8719 | 80% |
| 4.9152 | 3.0517 | 90% |
| 4.7168 | 3.0118 | 90% |
| 4.5185 | 2.9715 | 90% |
| 4.3202 | 2.9309 | 90% |
| 4.1220 | 2.8898 | 90% |
| 3.9240 | 2.8482 | 90% |
| 3.7260 | 2.8061 | 90% |
| 3.5282 | 2.7635 | 90% |
| 3.3305 | 2.7203 | 90% |
| 3.1329 | 2.6764 | 90% |
| 2.9355 | 2.6317 | 90% |
| 2.7383 | 2.5863 | 90% |
| 2.5413 | 2.5400 | 90% |
| 2.3445 | 2.4928 | 90% |
| 2.1479 | 2.4446 | 90% |
| 1.9516 | 2.3953 | 90% |
| 1.7557 | 2.3448 | 90% |
| 1.5600 | 2.2931 | 90% |
| 1.3647 | 2.2400 | 90% |
| 1.1697 | 2.1857 | 90% |
| 0.9752 | 2.1299 | 90% |
| 0.7811 | 2.0727 | 90% |
| 0.5874 | 2.0141 | 90% |
| 0.3941 | 1.9539 | 90% |
| 0.2015 | 1.8920 | 90% |
| 0.0094 | 1.8283 | 90% |
| −0.1821 | 1.7626 | 90% |
| −0.3727 | 1.6947 | 90% |
| −0.5624 | 1.6242 | 90% |
| −0.7510 | 1.5509 | 90% |
| −0.9384 | 1.4743 | 90% |
| −1.1242 | 1.3942 | 90% |
| −1.3084 | 1.3103 | 90% |
| −1.4907 | 1.2225 | 90% |
| −1.6711 | 1.1307 | 90% |
| −1.8493 | 1.0347 | 90% |
| −2.0250 | 0.9344 | 90% |
| −2.1981 | 0.8296 | 90% |
| −2.3682 | 0.7198 | 90% |
| −2.5346 | 0.6047 | 90% |
| −2.6967 | 0.4836 | 90% |
| −2.8537 | 0.3558 | 90% |
| −3.0043 | 0.2207 | 90% |
| −3.1473 | 0.0775 | 90% |
| −3.2812 | −0.0742 | 90% |
| −3.4045 | −0.2346 | 90% |

TABLE 1-continued

| X | Y | Z |
|---|---|---|
| −3.5154 | −0.4038 | 90% |
| −3.6126 | −0.5813 | 90% |
| −3.6956 | −0.7658 | 90% |
| −3.7636 | −0.9564 | 90% |
| −3.8141 | −1.1523 | 90% |
| −3.8431 | −1.3524 | 90% |
| −3.8447 | −1.5546 | 90% |
| −3.8127 | −1.7542 | 90% |
| −3.7428 | −1.9437 | 90% |
| −3.6355 | −2.1149 | 90% |
| −3.4945 | −2.2595 | 90% |
| −3.3251 | −2.3695 | 90% |
| −3.1353 | −2.4386 | 90% |
| −2.9349 | −2.4635 | 90% |
| −2.7341 | −2.4425 | 90% |
| −2.5432 | −2.3765 | 90% |
| −2.3700 | −2.2724 | 90% |
| −2.2151 | −2.1424 | 90% |
| −2.0748 | −1.9966 | 90% |
| −1.9450 | −1.8413 | 90% |
| −1.8218 | −1.6808 | 90% |
| −1.7020 | −1.5177 | 90% |
| −1.5834 | −1.3537 | 90% |
| −1.4641 | −1.1902 | 90% |
| −1.3418 | −1.0290 | 90% |
| −1.2139 | −0.8722 | 90% |
| −1.0787 | −0.7216 | 90% |
| −0.9363 | −0.5778 | 90% |
| −0.7877 | −0.4405 | 90% |
| −0.6342 | −0.3086 | 90% |
| −0.4770 | −0.1811 | 90% |
| −0.3170 | −0.0572 | 90% |
| −0.1548 | 0.0639 | 90% |
| 0.0091 | 0.1826 | 90% |
| 0.1743 | 0.2994 | 90% |
| 0.3405 | 0.4149 | 90% |
| 0.5075 | 0.5293 | 90% |
| 0.6753 | 0.6425 | 90% |
| 0.8438 | 0.7546 | 90% |
| 1.0129 | 0.8657 | 90% |
| 1.1828 | 0.9757 | 90% |
| 1.3533 | 1.0847 | 90% |
| 1.5246 | 1.1925 | 90% |
| 1.6965 | 1.2993 | 90% |
| 1.8691 | 1.4050 | 90% |
| 2.0425 | 1.5093 | 90% |
| 2.2168 | 1.6121 | 90% |
| 2.3921 | 1.7133 | 90% |
| 2.5683 | 1.8128 | 90% |
| 2.7456 | 1.9104 | 90% |
| 2.9240 | 2.0061 | 90% |
| 3.1034 | 2.0996 | 90% |
| 3.2840 | 2.1910 | 90% |
| 3.4657 | 2.2802 | 90% |
| 3.6483 | 2.3673 | 90% |
| 3.8320 | 2.4523 | 90% |
| 4.0166 | 2.5353 | 90% |
| 4.2020 | 2.6163 | 90% |
| 4.3884 | 2.6954 | 90% |
| 4.5755 | 2.7724 | 90% |
| 4.7634 | 2.8475 | 90% |
| 4.9522 | 2.9205 | 90% |

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

What is claimed is:

1. An airfoil for a turbine vane having an uncoated profile substantially in accordance with Cartesian coordinate values of X, Y, and Z as set forth in Table 1, carried to four decimal places, wherein X and Y are in inches, and Z is a percentage of the radial span of the airfoil measured radially from a radially outwardly facing surface of an inner platform and wherein the X and Y coordinates, when connected by smooth arcs, define an airfoil profile section at each Z coordinate.

2. The airfoil of claim 1, wherein the X and Y coordinate values of the airfoil have manufacturing tolerances of ±0.100 inches.

3. The airfoil of claim 1, wherein the airfoil is fabricated from a nickel-based alloy.

4. The airfoil of claim 1 further comprising a coating up to 0.055 inches thick.

5. The airfoil of claim 4, wherein the coating is at least a MCrAlY bond coating.

6. The airfoil of claim 1, wherein the turbine vane forms part of a first stage of a turbine.

7. A turbine vane comprising an inner platform, an outer platform, and an airfoil extending radially outward from the inner platform toward the outer platform, wherein the airfoil has an uncoated profile substantially in accordance with Cartesian coordinate values of X, Y, and Z as set forth in Table 1, carried to four decimal places, wherein X and Y are in inches, and Z is a percentage of the radial span of the airfoil measured radially from a radially outwardly facing surface of an inner platform and wherein the X and Y coordinates, when connected by smooth arcs, define an airfoil profile section at each Z coordinate.

8. The turbine vane of claim 7, wherein the X and Y coordinate values of the airfoil have manufacturing tolerances of ±0.100 inches.

9. The turbine vane of claim 7 further comprising an inner rail radially inward of the inner platform.

10. The turbine vane of claim 7, wherein the vane is fabricated from a nickel-based alloy.

11. The turbine vane of claim 7 further comprising at least a MCrAlY bond coating applied to the airfoil.

12. The turbine vane of claim 11, wherein the coating is applied up to 0.055 inches thick.

13. The turbine vane of claim 7, wherein the turbine vane forms a part of a first stage of a turbine.

14. A vane assembly for a first stage of a turbine, the vane assembly comprising: an inner platform; an outer platform; and a plurality of first stage vanes extending from the inner platform to the outer platform, each of the plurality of first stage blades comprising an airfoil including an uncoated profile substantially in accordance with Cartesian coordinate values of X, Y, and Z as set forth in Table 1, carried to four decimal places, wherein X and Y are in inches, and Z is a percentage of the radial span of the airfoil measured radially from a radially outwardly facing surface of an inner platform and wherein the X and Y coordinates, when connected by smooth arcs, define an airfoil profile section at each Z coordinate.

15. The vane assembly of claim 14, wherein the X and Y coordinate values of each airfoil have manufacturing tolerances of ±0.100 inches.

16. The vane assembly of claim 14 further comprising an inner rail radially inward of the inner platform.

17. The vane assembly of claim 14, wherein each of the plurality of first stage vanes is fabricated from a nickel-based alloy.

18. The vane assembly of claim 14 further comprising at least a MCrAlY bond coating applied to each airfoil.

19. The vane assembly of claim 18, wherein the coating is applied up to 0.055 inches thick.

20. The vane assembly of claim 14, wherein the plurality of first stage vanes are radially arrayed about a center axis of the turbine.

* * * * *